US009810378B2

(12) United States Patent
Ohno et al.

(10) Patent No.: US 9,810,378 B2
(45) Date of Patent: Nov. 7, 2017

(54) LIGHTING APPARATUS AND LIGHT GUIDE

(71) Applicant: Kabushiki Kaisha Toshiba, Minato-ku (JP)

(72) Inventors: Hiroshi Ohno, Yokohama (JP); Yuichiro Yamamoto, Yokohama (JP); Mitsuaki Kato, Kawasaki (JP); Katsumi Hisano, Matsudo (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 505 days.

(21) Appl. No.: 14/136,396

(22) Filed: Dec. 20, 2013

(65) Prior Publication Data

US 2014/0362599 A1 Dec. 11, 2014

(30) Foreign Application Priority Data

Jun. 11, 2013 (JP) ..... 2013-123101

(51) Int. Cl.
*F21V 3/02* (2006.01)
*F21K 9/232* (2016.01)
(Continued)

(52) U.S. Cl.
CPC ..... *F21K 9/232* (2016.08); *F21K 9/61* (2016.08); *F21V 3/02* (2013.01); *F21Y 2101/00* (2013.01); *F21Y 2115/10* (2016.08)

(58) Field of Classification Search
CPC ..... F21Y 2101/02; F21Y 2105/003; F21Y 2101/025; F21Y 2103/003;
(Continued)

(56) References Cited

U.S. PATENT DOCUMENTS 6,350,041 B1 2/2002 Tarsa et al.
7,261,456 B2 * 8/2007 Liu ..... F21L 4/00 362/551
(Continued)

FOREIGN PATENT DOCUMENTS

CN 201739822 U 2/2011
CN 102272514 A 12/2011
(Continued)

OTHER PUBLICATIONS

Office Action dated Oct. 27, 2015 in Japanese Patent Application No. 2013-123101 (with English language translation).
(Continued)

*Primary Examiner* — Stephen F Husar
(74) *Attorney, Agent, or Firm* — Oblon, McClelland, Maier & Neustadt, L.L.P.

(57) ABSTRACT

According to one embodiment, a lighting apparatus includes a light source which includes a light emitting surface, and a light guide provided to be coaxial with an axis which extends along a direction perpendicular to the light emitting surface. The light guide includes: an incident plane facing the light emitting surface; an outer circumferential surface configured to protrude in a direction extending away from the light source so as to surround the axis from an outer periphery of the incident surface and so as to totally reflect light from the light source which is made to enter the light guide from the incident surface; and a hollow part provided at a position distant in the axis direction from the incident surface. The hollow part includes a first light diffusing surface parallel to an axis along which the light totally reflected on the outer circumferential surface is led.

20 Claims, 13 Drawing Sheets

(51) Int. Cl.
*F21K 9/61* (2016.01)
*F21Y 101/00* (2016.01)
*F21Y 115/10* (2016.01)

(58) Field of Classification Search
CPC ..... F21Y 2113/005; F21Y 2103/00; F21Y 2111/005; F21Y 2101/00; F21Y 2115/10; H05B 33/0845; H05B 33/0803; F21K 9/50; F21K 9/52; F21K 9/61; F21K 9/232; F21V 9/16; F21V 19/045; F21V 2200/00; F21V 2200/15; F21V 23/002; F21V 3/02; G02B 6/0096; G02B 6/00; G02B 6/0073; G02B 6/0063; G02B 5/02; H01L 33/502; H01L 2924/12041; H01L 2924/12042; H01L 31/02363; H01P 3/06; F21S 48/215; F21S 48/2237; F21S 48/2281; G02F 1/133524; F21L 11/00
USPC ..... 362/22.09, 23.16, 551, 555, 558, 581
See application file for complete search history.

(56) References Cited

U.S. PATENT DOCUMENTS 7,726,860 B2 * 6/2010 Harrity ..... F21S 6/001 362/555
7,758,224 B2 * 7/2010 Hama ..... A61B 1/0653 362/231
2011/0267835 A1 11/2011 Boonekamp et al.
2012/0155091 A1 6/2012 Takatori et al.
2015/0029742 A1 * 1/2015 Chen ..... F21K 9/52 362/555

FOREIGN PATENT DOCUMENTS

| | | | |
|---|---|---|---|
| CN | 102563414 | A | 7/2012 |
| EP | 2 392 953 | A2 | 12/2011 |
| JP | 2003-86003 | A | 3/2003 |
| JP | 2011-238609 | A | 11/2011 |
| JP | 2012-514812 | A | 6/2012 |
| JP | 2012-514842 | A | 6/2012 |
| JP | 2013-33647 | A | 2/2013 |
| WO | WO 2011/159436 | A2 | 12/2011 |

OTHER PUBLICATIONS

Combined Office Action and Search Report dated Oct. 28, 2015 in Chinese Patent Application No. 201410258924.1 (with English language translation and English Translation of Category of Cited Documents).
Office Action dated Mar. 8, 2016 in Japanese Patent Application No. 2013-123101 (with English language translation).
Office Action dated Jul. 7, 2016 in Chinese Patent Application No. 201410258924.1 (with English language translation).

* cited by examiner

LIGHTING APPARATUS AND LIGHT GUIDE

CROSS-REFERENCE TO RELATED APPLICATION

This application is based upon and claims the benefit of priority from prior Japanese Patent Application No. 2013-123101, filed Jun. 11, 2013; the entire contents of which are incorporated herein by reference.

FIELD

Embodiments described herein relate generally to a lighting apparatus and a light guide.

BACKGROUND

In the field of LED lamps for general-purpose lighting, spreading and shining of light are demanded to follow (retrofit) those of incandescent light bulbs. Specifically, there is a strong demand for spreading light over a wide range from a point light source positioned in a center part of a glass globe, as in a clear electric light bulb.

However, LEDs have strong directivity, and a light distribution angle of an LED lamp is therefore as narrow as approximately 120 degrees if LEDs are used directly as a light source.

Hence, an LED lamp is commonly known which scatters light emitted from an LED over a wide range by using a light guide column. A conventional light guide column is arranged coaxially along an optical axis of an LED.

The light guide column comprises an incident plane and a tip end positioned on a side opposite to the incident plane. A scattering member is provided at the tip end of the light guide column.

When light emitted from LEDs is made to enter the incident plane of the light guide column, the incident light is led to the scattering member through the inside of the light guide column and penetrates the scattering member while the incident light is simultaneously reflected on the scattering member. Thus, the light which has penetrated and been scattered by the light guide column is emitted and diffused from the tip end of the light guide column.

A distribution angle of an LED lamp using a light guide column as described above increases as the number of times light is scattered by a scattering member increases.

However, when a scattering member is used, a part of scattered light returns in a direction of a light emitting module through a light guide column, and is absorbed by the light emitting module. In a common scattering member, internal scattering particles slightly absorb light. Therefore, when scattering takes place a greater number of times, light is absorbed at a greater ratio by a light emitting module and the scattering member.

As a result, light spreads in an improved manner while luminaire efficiency of a whole LED lamp deteriorates. There thus is still margin for improvement to effectively use the light emitted from LEDs.

Accordingly, development of a lighting apparatus is demanded which can achieve a wide light distribution and can simultaneously improve the luminaire efficiency.

DETAILED DESCRIPTION

According to one embodiment, a lighting apparatus comprises a light source which comprises a light emitting surface, and a light guide member provided to be coaxial with an axis which extends through a centroid of the light emitting surface along a direction perpendicular to the light emitting surface. The light guide member comprises an incident plane facing the light emitting surface, an outer circumferential surface configured to protrude in a direction extending away from the light source so as to surround the axis from an outer peripheral edge of the incident plane and so as to totally reflect light from the light source which has been made to enter the light guide member from the incident plane, and a hollow part provided at a position distant along an axis direction of the axis from the incident plane. The hollow part comprises a first light diffusing surface parallel to an axis along which the light totally reflected on the outer circumferential surface is led.

Various embodiments will be described hereinafter with reference to the accompanying drawings.

First Embodiment

Hereinafter, the first embodiment will be described with reference to FIGS. 1, 2, 3, 4, 5, and 6.

Figure 1:
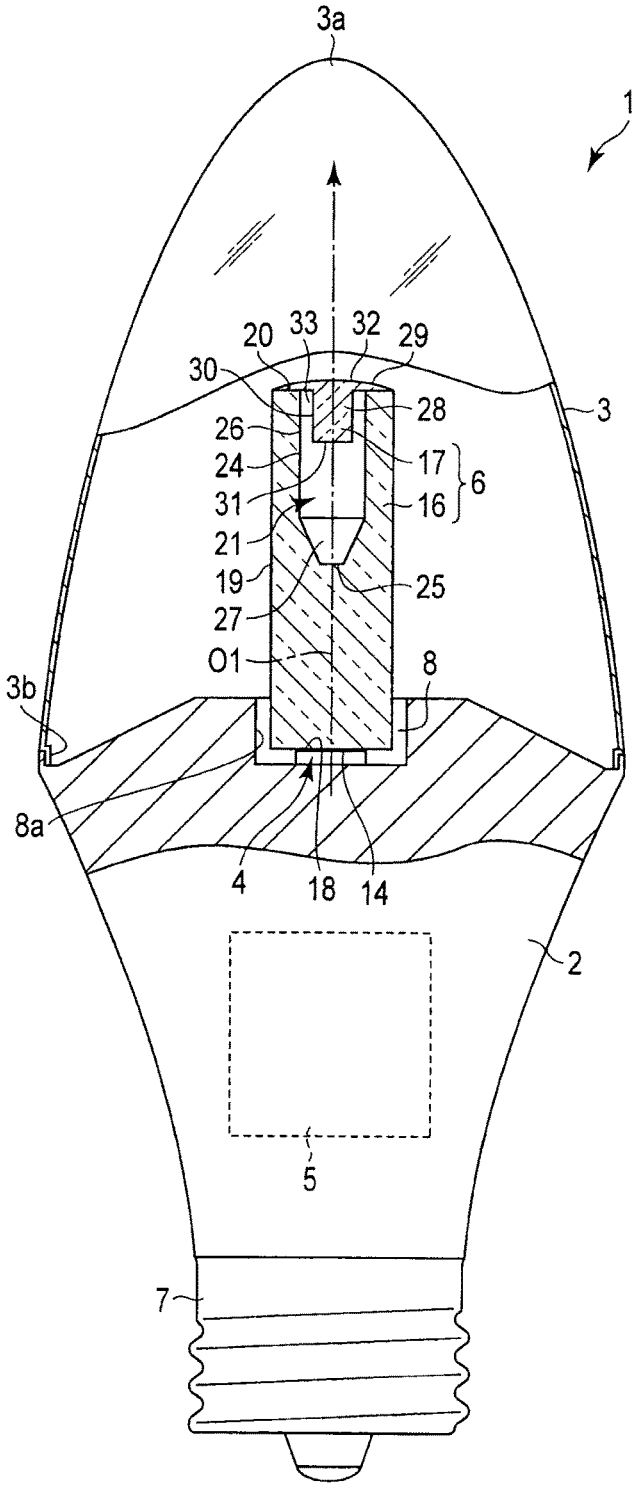
FIG. 1 is a sectional view showing a partial cross section of an LED lamp according to the first embodiment.
Figure 2:
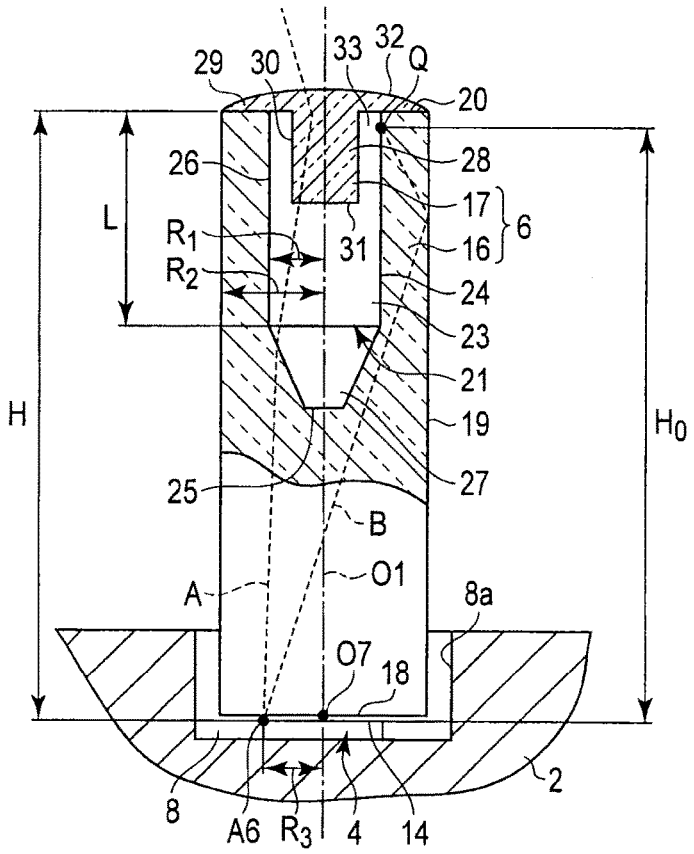
FIG. 2 is a sectional view showing a positional relationship between a light guide member and a COB-type light emitting module in the first embodiment.

FIG. 1 is a side view showing a partial cross section of an LED lamp as an example of a lighting apparatus. FIG. 2 is a sectional view showing a positional relationship between a light guide member and a COB-type light emitting module.

Figure 3:
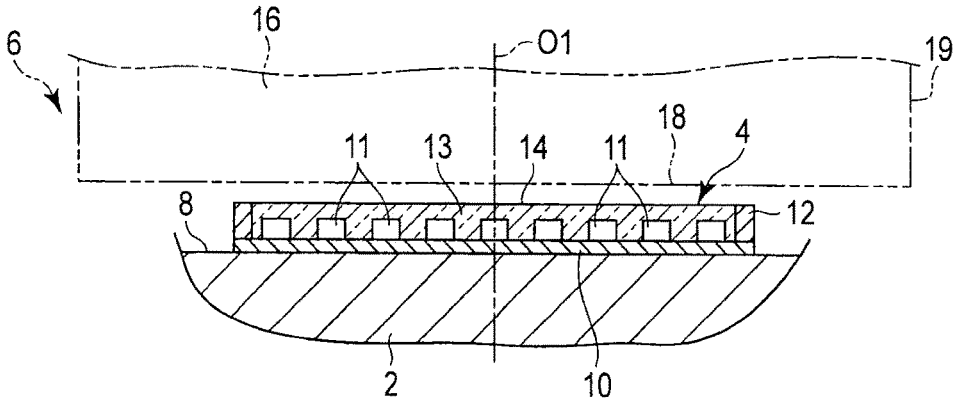
FIG. 3 is a sectional view of a light emitting module used in the first embodiment.
Figure 4:
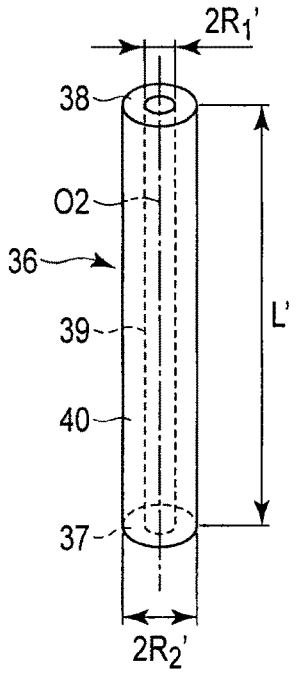
FIG. 4 is a perspective view of a cylindrical light guide column mentioned in descriptions of a first light diffusing surface in the first embodiment.
Figure 5:
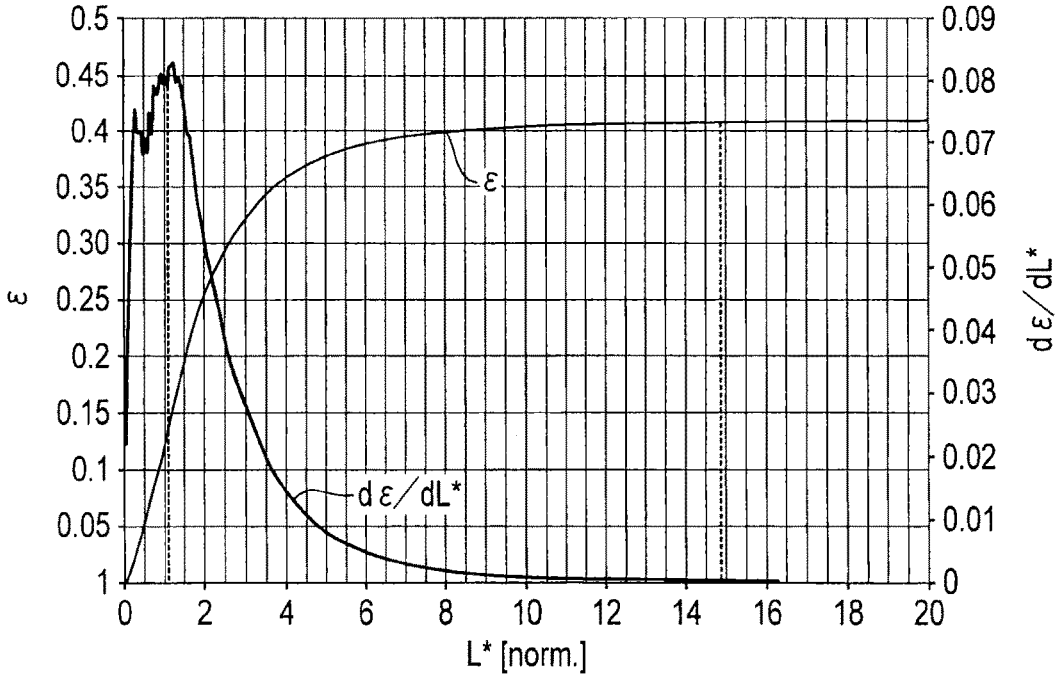
FIG. 5 is a graph showing a result of performing a ray-tracing simulation of whole light fluxes emitted from an outer circumferential surface of a cylindrical light guide column in the first embodiment.
Figure 6:
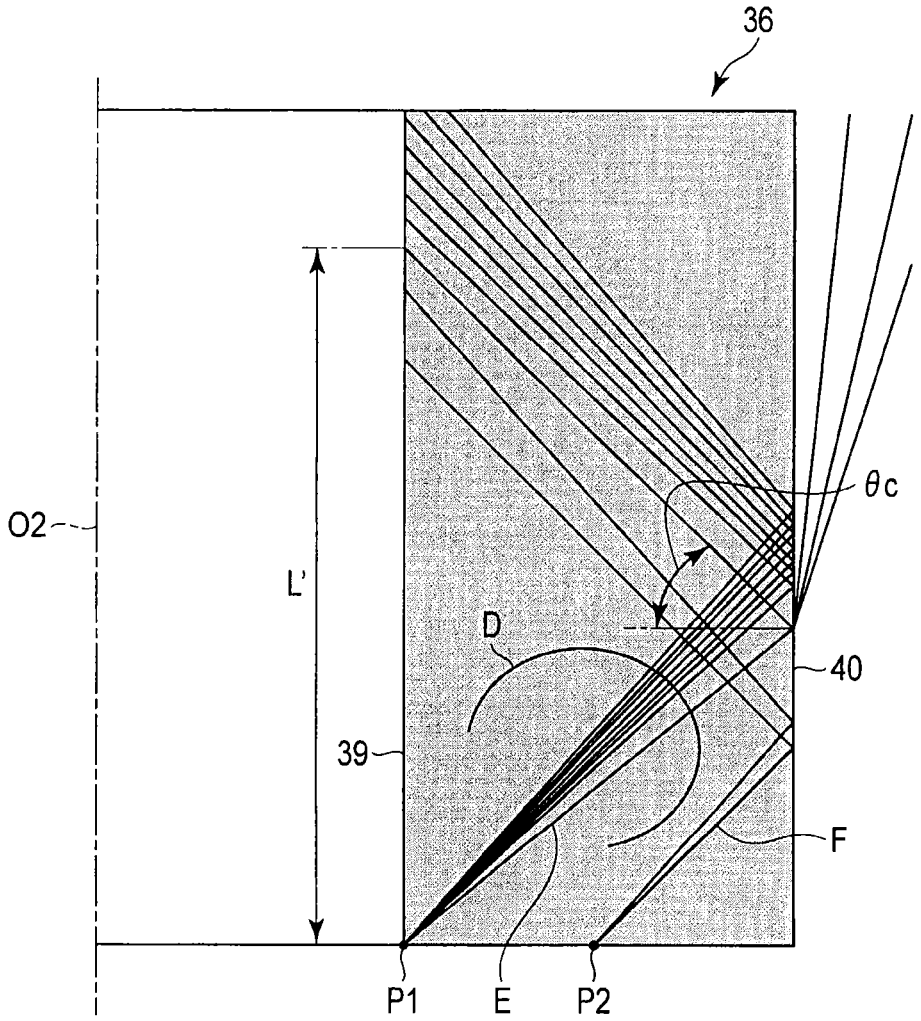
FIG. 6 is a diagram showing paths of light rays which have entered a light guide member from an incident plane in the first embodiment.

FIG. 3 is a sectional view of the light emitting module. FIG. 4 is a perspective view of a cylindrical light guide column mentioned in descriptions of a first light diffusing surface. FIG. 5 is a graph showing a result of performing a simulation of whole light fluxes emitted from an outer circumferential surface of the cylindrical light guide column. FIG. 6 is a diagram showing paths of rays of light which is made to enter the cylindrical light guide column from an incident plane.

FIG. 1 discloses an LED lamp 1 having, for example, a shape similar to a clear-type chandelier bulb. The LED lamp 1 comprises, as main components, a lamp body 2, a globe 3, a COB (chip on board) type light emitting module 4, a lighting circuit 5, and a light guide 6.

The lamp body 2 is made of a metal material having more excellent thermal conductivity than iron, such as aluminum, and functions also as a heat radiator. The lamp body 2 is a component having an approximately circular columnar shape, which has one end and another end, and is shaped to have a diameter which increases gradually toward the other end from the one end.

A base 7 having an E shape is attached to the one end of the lamp body 2. A recess 8 is formed in a central part of the other end of the lamp body 2. The recess 8 is positioned on the center axis of the lamp body 2. An inner circumferential surface of the recess 8 is finished, for example, into a white light diffusing surface 8*a*.

The globe 3 is formed in an approximately circular conical shape by using, for example, a transparent synthetic resin material such as acryl, or clear glass. The globe 3 comprises a top part 3*a* having a spherical shape, and an open end part 3*b* which faces the top part 3*a*. The open end part 3*b* defines the maximum diameter of the globe 3 and is connected coaxially with the other end of the lamp body 2.

According to the present embodiment, the lamp body 2 comprising the base 7 and the globe 3 form, in cooperation with each other, an outer shape similar to a chandelier bulb.

The globe 3 is not limited only to a conical shape but may have a semispherical shape. Further, the globe 3 may alternatively be made of, for example, a milk-white synthetic resin material to make the globe 3 light-diffusible.

The light emitting module 4 is a light source of the LED lamp 1, and is contained in the recess 8 of the lamp body 2. As shown in FIG. 3, the light emitting module 4 comprises an insulating substrate 10, a plurality of light emitting diodes 11, a frame 12, and a sealing material 13.

The insulated substrate 10 is a square whose edges each have, for example, a length of 3.2 mm and is fixed to the bottom surface of the recess 8 by means of screwing or the like. Further, the insulating substrate 10 is thermally connected to the bottom surface (lamp body 2) of the recess 8, for example, by thermally conductive grease.

The light emitting diodes 11 are an example of a semiconductor light emitting device, and are arrayed in a matrix on the insulating substrate 10. The frame 12 is adhered to an outer circumferential part of the insulating substrate 10, and surrounds the light emitting diodes 11.

The sealing material 13 is a transparent or translucent resin material containing fluorescent particles. The sealing agent 13 is filled in a region surrounded by the frame 12 so as to cover all the light emitting diodes 11.

The fluorescent particles contained in the sealing material 13 are excited by light emitted from the light emitting diodes 11, and emit light of a complementary color for light emitted from the light emitting diodes 11. As a result, the light emitted from the light emitting diodes 11 and the light emitted from the fluorescent particles are mixed inside the sealing material 13, forming white light. The white light is injected from a surface of the sealing agent 13.

Therefore, the surface of the sealing material 13 configures a rectangular light emitting surface 14 which emits planar light. According to the present embodiment, the light emitted from the light emitting surface 14 is visible light having a wavelength from 400 nm to 800 nm although the wave length of light is not limited to this wavelength.

As shown in FIGS. 1 and 2, the light emitting module 4 has a straight optical axis O1 as its axis. The optical axis O1 extends through the center of the light emitting surface 14 or the vicinity of the center in a direction perpendicular to the light emitting surface 14.

The center of the light emitting surface 14 corresponds to the centroid of the light emitting surface 14. Therefore, the center may be out of a region just on the light emitting surface 14 (hereafter, the phrase "on a surface" is intended to mean "part of a surface"). For example, where a light emitting surface has an annular shape, the center thereof is the center of an outer circle or an inner circle defining the annular shape of the light emitting surface, and does not exist on the light emitting surface.

Light distribution of the light emitted from the light emitting surface 14 is nearly symmetrical about the optical axis O1. Specifically, the light emitting surface 14 has a light distribution close to, for example, a Lambertian type although the light distribution is not limited to this type.

Further, in the present embodiment, the regular direction of the optical axis O1 is defined as a direction of light extracted along the optical axis O1 from the light emitting surface 14. The direction of light extracted along the optical axis O1 is a direction at a distribution angle of 0 degrees, and corresponds to an outward normal vector toward the globe 3 from the light emitting surface 14.

The lighting circuit 5 is a component for supplying a constant current to the light emitting module 4. The lighting circuit 5 is contained inside the lamp body 2, and is electrically connected to the base 7 and the light emitting diodes 11.

As shown in FIG. 1, the light guide 6 is contained inside the globe 3 so as to face the light emitting surface 14 of the light emitting module 4. The light guide 6 of the present embodiment comprises a light guide column 16 and a light diffuser 17.

The light guide column 16 is an example of a light guide member and is provided to be coaxial with the optical axis O1. Further, the light guide column 16 has a shape which is rotationally symmetrical about the optical axis O1. The term "rotationally symmetrical" herein means that a shape of an object rotated about the optical axis O1 corresponds to the shape of the object in an original position (not rotated) while the rotated angle is less than 360 degree. In the present embodiment, the light guide column 16 has a straight circular columnar shape.

The light guide column 16 is made of, for example, transparent acryl. Acryl has a refractive index n of 1.49. The light guide column 16 is not limited to acryl but may be a transparent material such as polycarbonate or glass which allows visible light to penetrate. There is no particular limitation to the material of the light guide column 16.

As shown in FIGS. 1 and 2, the light guide column 16 comprises an incident plane 18, an outer circumferential surface 19, a tip end surface 20, and a hollow part 21.

The incident plane 18 is a flat circular surface perpendicular to the optical axis O1, and faces the light emitting surface 14 of the light emitting module 4. The incident plane 18 has a larger shape than the light emitting surface 14.

Further, the incident plane 18 includes a point O7 at which the incident plane intersects the optical axis O1.

The outer circumferential surface 19 extends in a direction extending away from the light emitting module 4 so as to coaxially surround the optical axis O1 from an outer peripheral edge of the incident plane 18. The outer circumferential surface 19 extends in parallel with the optical axis O1. The outer circumferential surface 19 can function as a total reflection surface which totally reflects the light of the light emitting diodes 11 made to enter the light guide column 16 from the incident plane 18. The outer circumferential surface 19 as a total reflection surface is finished into a smooth glossy surface.

A critical angle $\theta_C$ which achieves total reflection, in relation to the outer circumferential surface 19, can be expressed as follows by using the refractive index n of the light guide column 16.

$$\theta_C = \sin^{-1}\left(\frac{1}{n}\right) \tag{1}$$

In the present embodiment, the light guide column 16 is made of acryl, and the critical angle $\theta_C$ is 42.2.

The tip end surface 20 is a flat surface perpendicular to the optical axis O1, and is positioned in a side opposite to the incident plane 18 along the axial direction of the optical axis O1.

As shown in FIG. 2, the hollow part 21 is formed in the tip end side of the light guide column 16, and is distant from the incident plane 18 along the axial direction of the optical axis O1. The hollow part 21 has a cylindrical shape coaxial with the optical axis O1 and is open in the tip surface 20 of the light guide column 16.

An inner surface 23 which defines the hollow part 21 comprises a circumferential surface 24 surrounding the optical axis O1, and a bottom surface 25 perpendicular to the optical axis O1. The circumferential surface 24 comprises a first light diffusing surface 26 parallel to the optical axis O1. The first light diffusing surface 26 is continuous to the tip end surface 20 of the light guide column 16. The bottom surface 25 faces the incident plane 18 at the bottom of the hollow part 21.

Further, the inner surface 23 of the hollow part 21 comprises a diffusion region 27 which connects the first light diffusing surface 26 to the bottom surfaces 25. The diffusion region 27 is defined by a tapered surface inclined so as to gradually approach the optical axis O1 from the first light diffusing surface 26 toward the bottom surface 25.

The inner surface 23 of the hollow part 21 including the first light diffusing surface 26 is made of a rough surface having light diffusibility. The rough surface is formed by so-called sandblasting of spraying, for example, a polishing material having a grain diameter of 100 μm to the inner surface 23. In this manner, much unevenness is formed in the inner surface 23, and a white surface which has light reflectivity without using a scattering member can be obtained.

The measure of making the inner surface 23 light-diffusible is not limited to sandblasting. For example, a coating material including particles (scattering particles) for scattering light may be coated on the inner surface 23. The film thickness of the coating material coated on the inner surface 23 may be so thin as to allow light to penetrate.

Specifically, absorption of light by the coated coating material is negligible insofar as the film thickness of a coating material is 1 mm or less. In this case, scattering particles exist only on surfaces of an object, and scattering particles are not distributed within the volume of the object, unlike the scattering member. In actual practice, when light penetrates the scattering member, absorption of light is not negligible.

FIG. 2 shows a cross sectional shape of the hollow part 21 where the light guide column 16 is cut along a plane including the axis of the optical axis O1. In FIG. 2, the distance from the first light diffusing surface 26 to the optical axis O1 along a direction perpendicular to the optical axis O1 is expressed as $R_1$, and the distance from the outer circumferential surface 19 of the light guide column 16 to the optical axis O1 along a direction perpendicular to the optical axis O1 is expressed as R2. The length of the first light diffusing surface 26 along the axial direction of the optical axis O1 is expressed as L. The first light reflex surface 26 satisfies a relationship below.

$$L \geq 2(R_2 - R_1)\tan\theta_C \tag{2}$$

For example, where the distance $R_2$ is 2.0 mm, the distance $R_1$ is 1.3 mm, and the length L is 3.4 mm, a relationship below exists.

$$L = 3.4 \geq 2(R_2 - R_1)\tan\theta_C = 1.3 \tag{3}$$

Further, the maximum distance H from the tip end of the first light diffusing surface 26 which reaches the tip end surface 20 of the light guide column 16 to the light emitting surface 14 satisfies a relationship below, where $R_3$ is the distance to the optical axis O1 from an end point A6 on the peripheral edge of the light emitting surface 14 along the direction perpendicular to the optical axis O1.

$$H \geq (2R_2 + R_3 - R_1)\tan\theta_C \tag{4}$$

In the present embodiment, the maximum distance H is 22.3 mm.

The distance $R_3$ takes a value which varies depending on the position of the cross section extending through the light emitting surface 14 unless the light emitting surface 14 has a circular shape or an annular shape.

Hence, the following expression is defined where C is the area of the light emitting surface 14.

$$R_3 = \sqrt{\frac{C}{\pi}} \tag{5}$$

According to the present embodiment, $R_3$ is 1.8 mm. Therefore, the present embodiment gives an expression below, and thus satisfies the expression 4 above.

$$H = 22.3 \geq (2R_2 + R_3 - R_1)\tan\theta_C = 4.1 \tag{6}$$

As shown in FIGS. 1 and 2, the light diffuser 17 of the light guide 6 is partially contained in the hollow part 21 of the light guide column 16. The light diffuser 17 is made of, for example, transparent acryl, though is not limited to acryl. Any material can be appropriately selected and used insofar as the material allows visible light to penetrate.

As shown in FIG. 2, the light diffuser 17 comprises a post part 28 and a flange part 29. The post part 28 is a solid cylindrical component having a smaller diameter than the hollow part 21, and comprises a second light diffusing surface 30 parallel to the optical axis O1, and a flat end surface 31 perpendicular to the optical axis O1.

The flange part 29 is formed coaxially in the end opposite to the end surface 31 of the post part 28, and protrudes in radial directions of the post part 28. The surface of the flange part 29 forms the third light diffusing surface 32 which bulges into a spherical shape.

The flange part 29 is fixed to the tip end surface 20 of the light guide column 16 by means of adhesion. By this fixture, the post part 28 of the light diffuser 17 is held coaxially inside the hollow part 21, and an open end of the hollow part 21 is closed by the flange part 29. Further, an annular air layer 33 is provided between the first light diffusing surface 26 of the hollow part 21 and the second light diffusing surface 30 of the light diffuser 17.

According to the present embodiment, the second light diffusing surface 30 of the light diffuser 17, the end surface 31, and the third light diffusing surface 32 are configured by rough surfaces which are light-diffusible. The rough surfaces are formed by so-called sandblasting of spraying, for example, a polishing material having a grain diameter of 100 μm to the surface of the light diffuser 17.

The measure of making the light diffuser 17 light-diffusible is not limited to sandblasting. For example, a coating material including particles for scattering light may be coated on the surface of the light diffuser 17. At this time, the film thickness of the coating material to be coated on the inner surface 23 may be so thin as to allow light to penetrate.

An end of the light guide column 16 having such a light diffuser 17, which comprises the incident plane 18, is held in the hollow part 8 of the lamp body 2. Therefore, the end of the light guide column 16 is surrounded by the light diffusing surface 8*a* of the hollow part 8, and the tip end of the light guide column 16 including the light diffuser 17 is positioned in the central part of the globe 3.

Light emitted from the light emitting surface 14 of the light emitting module 4 enters the inside of the light guide column 16 through the incident plane 18. Specifically, as illustrated by a light ray A in FIG. 2, the light toward the hollow part 21 along the optical axis O1 from the end point A6 on the peripheral edge of the light emitting surface 14 is diffused on and penetrates the diffusion region 27 of the hollow part 21, and thereafter enters the end surface 31 of the light diffuser 17.

Light which is made to enter the light diffuser 17 is diffused on and penetrates the third light diffusing surface 32, and thereafter travels in the positive direction of the optical axis O1. In other words, the light diffuser 17 performs a function to diffuse light toward the direction of the light distribution angle of 0 degrees, and prevents the luminous intensity at the light distribution angle of 0 degree from increasing too much.

On the other hand, as indicated by the light ray B in FIG. 2, light which travels toward the outer circumferential surface 19 through the periphery of the hollow part 21 from the end point A6 of the light emitting surface 14 approaches the outer circumferential surface 19, at an incident angle of θC or more in relation to the outer circumferential surface 19. Light which is made to approach the outer circumferential surface 19 is totally reflected toward the first light diffusing surface 26 of the hollow part 21.

In the present embodiment, the diffusion region 27 is configured by a tapered surface inclined so as to gradually approach the optical axis O1 from the first light diffusing surface 26 toward the bottom surface 25. Therefore, the bottom surface 25 which faces the incident plane 18 is narrow, and can reduce the ratio at which the light made to enter the light guide column 16 from the incident plane 18 is reflected on the bottom surface 25 and tries to return in a direction toward the incident plane 18.

In other words, most of the light which is made to enter from the incident plane 18 is not reflected on the bottom surface 25 but is led to the outer circumferential surface 19 as a total reflection surface through the periphery of the hollow part 21. Therefore, the light which is made to enter into the incident plane 18 can be efficiently led to the outer circumferential surface 19 and be totally reflected.

The light intensity at the light distribution angle of 0 degrees has been found to tend to decrease if the diffusion region 27 of the hollow part 21 is sharpened to be tapered. In addition, if the diffusion region 27 of the hollow part 21 is sharpened, the diffusion region 27 is difficult to process, which makes it difficult to improve processing accuracy of the hollow part 21.

Light which is totally reflected on the outer circumferential surface 19 of the light guide column 16 toward the first light diffusing surface 26 penetrates and is diffused by the first light diffusing surface 26. Here, diffusion of light is supposed to be of a semi-Lambertian (approximate Lambertian) type.

Then, the light which is reflected and diffused by the first light diffusing surface 26 is diffused in the semi-Lambertian manner, centering on an inward normal toward the outer circumferential surface 19 from a point on the first light diffusing surface 26, and is emitted from the outer circumferential surface 19 toward the globe 3.

The light which penetrates and is diffused by the first light diffusing surface 26 reaches the inner surface 23 of the hollow part 21 and penetrates and is diffused, or is reflected and diffused. Further, since an air layer 33 exists between the first light diffusing surface 26 of the hollow part 21 and the second light diffusing surface 30 of the light diffuser 17, the light reaches and is diffused not only by the first light diffusing surface 26 but also by the second light diffusing surface 30. Owing to this recursive diffusion, final diffusion of light is of a perfect Lambertian type. Therefore, light can be advantageously diffused over a wide range for achieving a wide light distribution.

The light which is reflected and diffused by the inner surface 23 of the hollow part 21 is further Lambertian-type diffused, centering on an inward normal toward the outer circumferential surface 19 from a point on the first light diffusing surface 26, and is finally emitted from the outer circumferential surface 19 toward the globe 3.

As a result, strongly directive light emitted from the light emitting surface 14 of the light emitting module 4 is diffused in all directions when the light is radiated from the outer circumferential surface 19 of the tip end of the light guide column 16. Accordingly, a wide light distribution is achieved.

If the normal vector of the inner surface 23 of the hollow part 21 were supposed to correspond to the direction of the optical axis O1, the light which reaches the inner surface 23 of the hollow part 21 were diffused in the semi-Lambertian manner with reference to the optical axis O1. Most of the light components which reached and were reflected by the inner surface 23 of the hollow part 21 return in the direction toward the light-emitting module 4 through the light guide column 16. Therefore, the luminaire efficiency of the LED lamp 1 would have deteriorated.

On the other hand, the component of light which penetrated the inner surface 23 of the hollow part 21 would have the maximum light distribution angle of 60 degrees or so at which ½ of the luminous intensity at the light distribution angle of 0 degrees is obtained, even if diffusion of light is of the Lambertian type.

In contrast, when the normal vector of the inner surface 23 of the hollow part 21 is perpendicular to the optical axis O1 as is the case of this embodiment, the light which reaches the inner surface 23 of the hollow part 21 is semi-Lambertian diffused with reference to the vector perpendicular to the optical axis O1.

As a result, the light which is reflected by the inner surface 23 and returns in the direction to the light emitting module 4 decreases in comparison with the case where the normal vector of the inner surface 23 of the hollow part 21 corresponds to the direction of the optical axis O1. Therefore, the luminaire efficiency of the LED lamp 1 can be prevented from deterioration.

Further, the component of the light which penetrates the inner surface of the hollow part 21 has a distribution angle which can be as wide as 150 degrees at maximum. In addition, when light is finally emitted from the light guide column 16, the light distribution angle widens much more owing to refraction of light by the outer circumferential surface 19.

That is, the light distribution angle can be large even though the directivity of the light emitted from the light emitting surface 14 of the light emitting module 4 is strong. In actual practice, some of light of the light emitting diodes 14 emitted through the light emitting surface 14 is finally radiated from the light guide column 16 in directions within the light distribution angle of 90 degrees. Therefore, the light distribution angle of the light finally emitted from the light guide column 16 is within a range of 0 to 150 degrees. Therefore, the maximum value of the light distribution angle at which half of the maximum luminous intensity is obtained can be approximately 300 degrees.

From the above, when the normal vector of the inner surface 23 of the hollow part 21 is perpendicular to the optical axis O1, a wide light distribution with which the ½ light distributing angle is approximately 300 degrees can be achieved while preventing the luminaire efficiency of the LED lamp 1 from deterioration.

In other words, of the light which is made to enter the light guide column 16 from the incident plane 18, the component of light which is going to return in the direction to the incident plane 18 can be reduced by providing the first light diffusing surface 26 parallel to the optical axis O1 in the inner surface 23 of the hollow part 21. At the same time, the component of light which is emitted in all directions from the outer circumferential surface 19 of the light guide column 16 can be increased. Therefore, the light emitted from the light emitting module 4 can be efficiently used for the purpose of lighting.

The length L along the axial direction of the optical axis O1 of the first light diffusing surface 26 of the hollow part 21 is important in efficiently guiding the light totally reflected on the outer circumferential surface 19 of the light guide column 16 to outside of the light guide column 16. Next, the length L of the first light diffusing surface 26 will be described with reference to a light guide column 36 which has a simpler shape than the actual light guide column 16.

FIG. 4 shows a cylindrical light guide column 36 whose length, outer diameter, and inner diameter are L', $2R_1$', and $2R_2$', respectively. The cylindrical light guide column 36 is rotationally symmetrical about the axis line O2. The outer radius $R_2$' of the cylindrical light guide column 36 is 2.0 mm, and the inner radius $R_1$' thereof is 1.0 mm. Further, the cylindrical light guide column 36 is made of transparent acryl, and has a refractive index n of 1.49.

As shown in FIG. 4, the cylindrical light guide column 36 comprises an annular incident end surface 37, an annular tip end surface 38, an inner circumferential surface 39, and an outer circumferential surface 40. The incident end surface 37 is positioned at an end along the axial direction of the cylindrical light guide column 36, and faces an annular light source (not shown). The light distribution of the light source is of the Lambertian type, and all the light emitted from the light source enters the incident end face 37.

The tip end surface 38 is positioned in the other end along the axial direction of the cylindrical light guide column 36, and perfectly absorbs the light which is made to enter the cylindrical light guide column 36 from the incident end surface 37. The inner circumferential surface 39 reflects all the light which reaches the inner circumferential surface 39 by reflection of the Lambertian type.

Under conditions described above, all light fluxes emitted from the outer circumferential surface 40 of the cylindrical light guide column 36 can be calculated by using a ray tracing simulation. Light Tools (registered trademark) manufactured by Synopsys was used in this simulation.

FIG. 5 shows a calculation result when the length L' of the cylindrical light guide column 36 was changed variously. In FIG. 5, the axis of abscissa represents the length L' of the cylindrical light guide column 36 which is standardized by an expression below (obtained by dividing L' by $L_F$).

$$L_F=2(R_2-R_1)\tan\theta_C \tag{7}$$

The standardized length L' is expressed as L*. Here, $L_F$ corresponds to the right side of the foregoing expression (2).

In FIG. 5, the main axis of the ordinate on the left side represents a ratio of all light fluxes of light emitted from the outer circumferential surface 40 of the cylindrical light guide column 36 in relation to all fluxes of light emitted from the annular light source. This ratio is expressed as $\epsilon$. Further in FIG. 5, the sub-axis of ordinate on the right side represents a differential coefficient of $\epsilon$ in relation to L*.

According to FIG. 5, $\epsilon$ increases in accordance with increase of L*, and is uniquely stabilized when L* reaches approximately 16. Hence, a setting of L*=16 can be said to increase all fluxes of light emitted from the outer circumferential surface 40 of the cylindrical light guide column 36. However, in consideration of the compactness of the cylindrical light guide column 36, a smaller L* is better.

Also, according to FIG. 5, the differential coefficient is maximized when L* is approximately 1. This means that, when L* is close to 1, all light fluxes of the light emitted from the outer circumferential surface 40 are abruptly increased by extending L*. That is, all the light fluxes can be efficiently increased by setting L* to be 1 or more.

This feature can be proved also from FIG. 6. FIG. 6 shows a partial cross section of the cylindrical light guide column 36 which extends through the center axis O2. Supposing that light is diffused and reflected at an arbitrary point P1 on the inner circumferential surface 39 of the cylindrical light guide column 36, diffused light D as shown in FIG. 6 appears.

Here, the critical angle $\theta_C$ is supposed to be a total reflection angle at which a light ray E of the diffused light D is totally reflected on the outer circumferential surface 40 of the cylindrical light guide column 36. At this time, in order to diffuse again the light ray E on the inner circumferential surface 39, which has been totally reflected once on the outer circumferential surface 40, the length L' of the inner circumferential surface 39 along the axial direction of the axis line O2 needs to be L* or more.

Conversely, if the length L' is L* or more, a light ray F, which travels through an arbitrary point P2 at a position more shifted away in a direction toward the outer circumferential surface 40 than the point P1 and has a critical angle $\theta_C$ as the total reflection angle on the outer circumferential surface 40, is led to and diffused on the inner circumferential surface 39.

In other words, if the length L' of the inner circumferential surface 39 is L* or more, there is light which travels through the point P1 and is recursively diffused on the inner circumferential surface 39. Otherwise, if the length L' is smaller than L*, there is no light which travels through the point P1 and is recursively diffused on the inner circumferential surface 39.

Therefore, when the length L' of the inner circumferential surface 39 is L* or more, the light which is recursively diffused on the inner circumferential surface 39 reaches the outer circumferential surface 40, and the quantity of light emitted from the outer circumferential surface 40 increases. From the above, L* may be set to be not smaller than 1 and not greater than 16.

Accordingly, the length L of the first light diffusing surface 26 of the hollow part 21 desirably satisfies a relationship below.

$$1 \leq \frac{L}{2(R_2 - R_1)\tan\theta_C} \leq 16 \tag{8}$$

Further in FIG. 2, a light ray B which travels through the periphery of the hollow part 21 from an end point A6 of the light emitting surface 14 toward the outer circumferential surface 19 is supposed to be totally reflected at the critical angle $\theta_C$ on the outer circumferential surface 19. At this time, the light which is totally reflected on the outer circumferential surface 19 is supposed to be made to reach the first light diffusing surface 26 of the hollow part 21 at a point Q.

Then, all the light which is totally reflected on the outer circumferential surface 19 immediately after being emitted from the light emitting surface 14 is made to reach the first light diffusing surface 26 at a position apart from the point Q in the direction toward the tip end surface 20 of the light guide column 16, or is made to directly enter the tip end surface 20.

At this time, a distance $H_0$ to the light emitting surface 14 along the axial direction of the optical axis O1 from the point Q where the light ray B is made to enter the first light diffusing surface 26 can be expressed as follows.

$$H_0=(2R_2+R_3-R_1)\tan\theta_C \tag{9}$$

Therefore, a relationship below needs to be satisfied in order to lead light, which is totally reflected on the outer circumferential surface 19 immediately after emitting from the light emitting surface 14, to the first light diffusing surface 26.

$$H \geq H_0 \tag{10}$$

This relationship is equivalent to the foregoing expression (4).

In the LED lamp 1 according to the first embodiment, most of the strong directive light of the light emitting diodes 11 is led to the hollow part 21 positioned at the tip end of the light guide column 16 after being made to enter the incident plane 18 of the light guide column 16, and is diffused in all directions from the tip end of the light guide column 16.

That is, the tip end of the light guide column 16 positioned in the central part of the globe 3 is the center of light from which the light is emitted over a wide range. Additionally, owing to the transparent appearance of the tip end of the light guide column 16 which emits light through the transparent globe 3, light can be obtained which creates a sense of glittering like a clear chandelier bulb.

Further, the first light diffusing surface 26 to which light totally reflected on the outer circumferential surface 19 of the light guide column 16 is led is arranged along the optical axis O1. Accordingly, the component of light which is diffused on the first light diffusing surface 26 and is going to return to the light emitting module 4 is reduced, and the length L of the first light diffusing surface 26 is defined. Therefore, a light distribution angle of 300 degrees equivalent to an incandescent light bulb can be achieved efficiently.

Accordingly, there is provided an LED lamp 1 which has high luminaire efficiency and has a point light source with wide light distribution.

The configuration of the light emitting module is not particularly limited to the first embodiment described above. For example, two or more types of light emitting diodes which emit different colors may be combined.

According to such a configuration as described, light of a plurality of colors emitted from the light emitting diodes mixes sufficiently through the process of diffusion inside the light guide column. As a result, the color of light finally emitted from the tip end of the light guide column hardly varies and illumination light with little color irregularity can be obtained.

Further, the light emitting module is not limited to the COB type but may employ, for example, a plurality of SMD-type (surface mount device type) light emitting modules.

Second Embodiment

FIGS. 7, 8, 9, 10, 11, and 12 disclose the second embodiment.

An LED lamp 51 according to the second embodiment is different from the first embodiment described above in the configuration of a lamp body 52, a globe 53, and a light guide 54.

Figure 7:
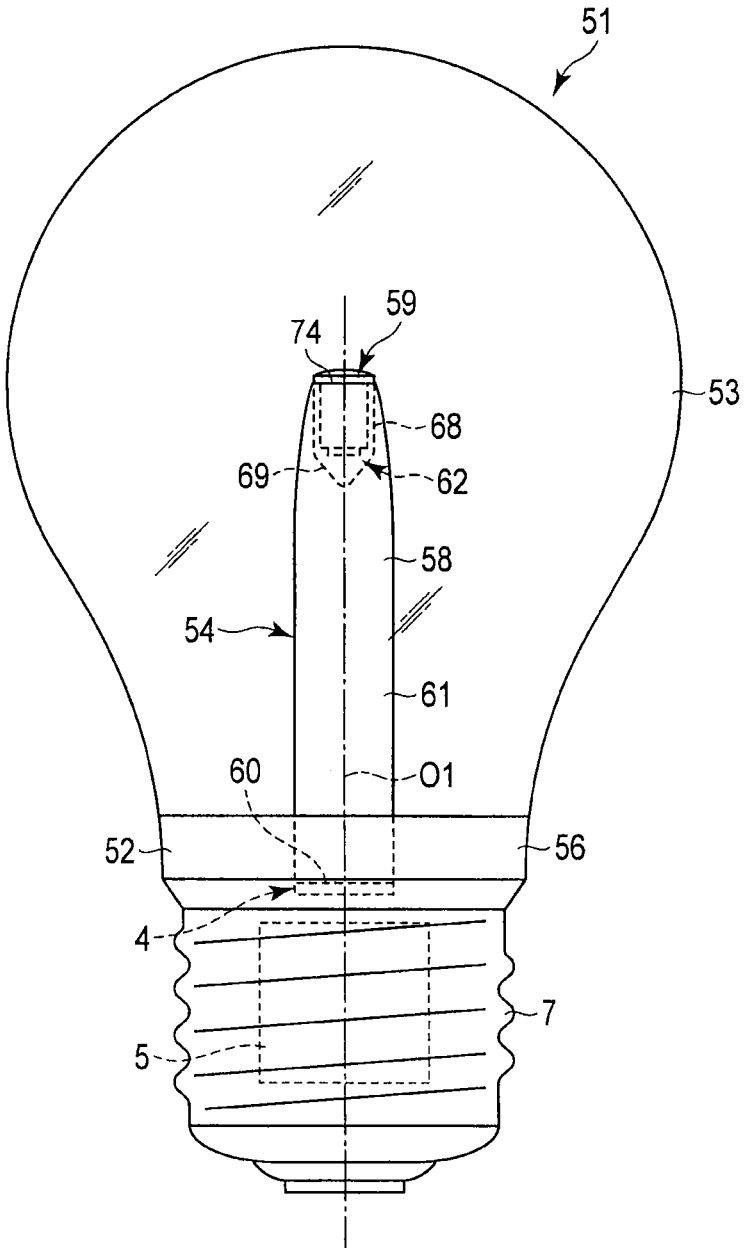
FIG. 7 is a side view of an LED lamp according to the second embodiment.

As shown in FIG. 7, the lamp body 52 comprises a support part 56 which closes an open end part of a base 7. A light emitting module 4 which is a light source of the LED lamp 51 is fixed to a central part of the support part 56 by screwing or adhesion. A lighting circuit 5 which supplies a constant current to the light emitting module 4 is contained in the base 7.

The globe 53 has a shape similar to a glass bulb of a clear electric light bulb and is made of a transparent synthetic resin material such as acryl or transparent glass. An open end of the globe 53 is jointed coaxially with the support part 56 of the lamp body 52. The globe 53 is arranged coaxially with the optical axis O1 of the light emitting module 4.

Therefore, the LED lamp 51 according to the present embodiment has a shape which is extremely similar to a clear electric light bulb.

Figure 8:
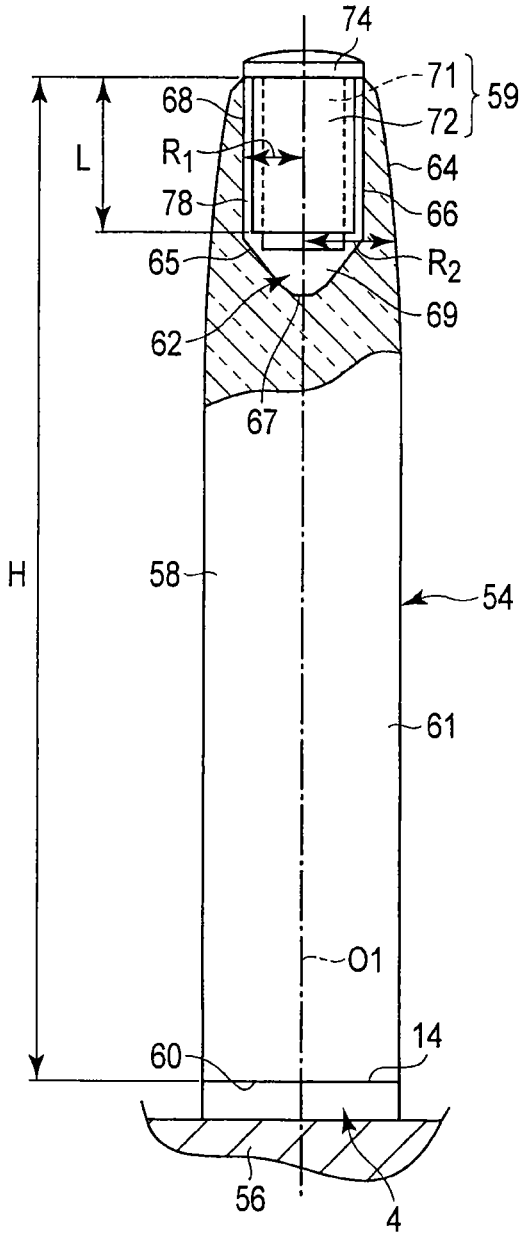
FIG. 8 is a side view showing a partial cross section of a light guide member used in the second embodiment.

As shown in FIGS. 7 and 8, a light guide 54 is contained in the globe 53 so as to face a light emitting surface 14 of the light emitting module 4. The light guide 54 comprises a light guide column 58 and a light diffuser 59.

The light guide column 58 is an example of a light guide member and is provided coaxially with the optical axis O1. The light guide column 58 has an approximately circular conical shape which is rotationally symmetrical about the optical axis O1 which has a maximum diameter of, for example, 4.2 mm. Further, the light guide column 58 is made of, for example, transparent acryl. Acryl has a refractive index n of 1.49.

As shown in FIG. 8, the light guide column 58 comprises an incident plane 60, an outer circumferential 61, and a hollow part 62. The incident plane 60 is a flat circular surface perpendicular to the optical axis O1, and faces the light emitting surface 14 of the light emitting module 4. The incident plane 60 has substantially the same size as the light emitting surface 14.

An outer circumferential surface 61 extends in a direction extending away from the light emitting module 4 so as to coaxially surround the optical axis O1 from an outer peripheral edge of the incident plane 60. The outer circumferential surface 61 extends in parallel with the optical axis O1. The outer circumferential surface 61 can also be referred to as a total reflection surface which totally reflects light of the light emitting module 11 which is made to enter the light guide column 58 from the incident plane 60. The outer circumferential surface 61 as a total reflection surface is finished into a smooth glossy surface.

According to the present embodiment, a tapered region 64 is provided at a tip end of the light guide column 58. The tapered region 64 is inclined to be slightly curved toward the optical axis O1 with increased distance from the incident plane 60 in an axial direction of the optical axis O1. Therefore, the outer circumferential surface 61 of the light guide column 58 is inclined to approach the optical axis O1 at positions corresponding to the tapered region 64.

Figure 9:
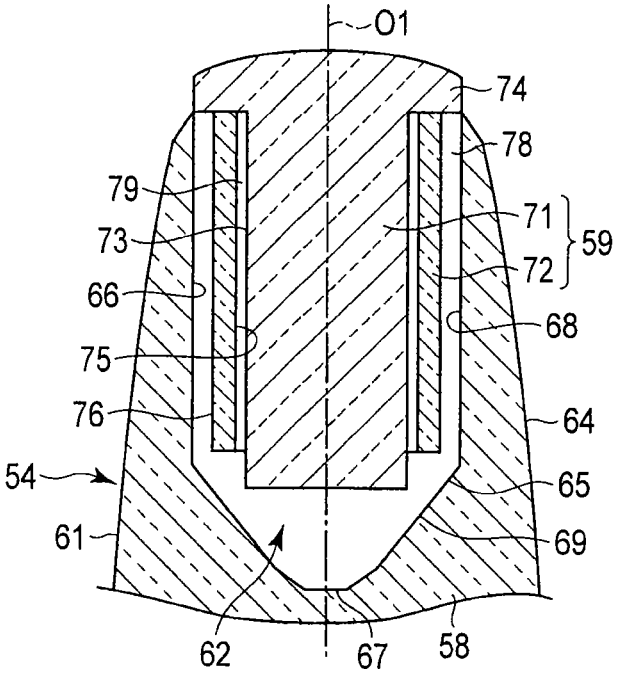
FIG. 9 is a sectional view of a tip end of the light guide member used in the second embodiment.

As shown in FIGS. 8 and 9, the hollow part 62 is provided at the tip end of the light guide column 58 which is apart from the incident plane 60. The hollow part 62 has an approximately cylindrical shape coaxial with the optical axis O1 and is open in the tip end of the light guide column 58.

An inner surface 65 which defines the hollow part 62 comprises a circumferential surface 66 surrounding the optical axis O1 and a bottom surface 67 perpendicular to the optical axis O1. The circumferential surface 66 includes the first light diffusing surface 68 parallel to the optical axis O1. The first light diffusing surface 68 is included in the tapered region of the light guide column 58. The bottom surface 67 faces the incident plane 60 at the bottom of the hollow part 62.

Further, the inner surface 65 of the hollow part 62 comprises a diffusion region 69 which connects the first light diffusing surface 68 and the bottom surfaces 67. The diffusion region 69 is defined by a tapered surface inclined so as to gradually approach the optical axis O1 from the first light diffusing surface 68 toward the bottom surface 67. The inner surface 65 of the hollow part 62 including the first light diffusing surface 68 is made of a rough surface having light diffusibility. The rough surface is formed by so-called sandblasting of spraying, for example, a polishing material having a grain diameter of 100 μm to the inner surface 65.

FIG. 9 shows a cross sectional shape of the hollow part 62 where the light guide column 58 is cut along a plane including the optical axis O1. According to the present embodiment, a distance $R_1$ to the optical axis O1 along a direction perpendicular to the optical axis O1 from the first light diffusing surface 68 is supposed to be 1.3 mm, a maximum distance $R_2$ to the optical axis O1 along a direction perpendicular to the optical axis O1 from the outer circumferential surface 61 of the light guide column 58 including the first light diffusing surface 68 is supposed to be 2.0 mm, and a length L of the first light diffusing surface 66 along the axial direction of the optical axis O1 is supposed to be 3.4 mm.

Then, the first light diffusing surface 68 of the hollow part 62 satisfies a relationship below where a critical angle is expressed as $\theta_C$.

$$L=3.4\geq 2(R_2-R_1)\tan\theta_C=1.3 \quad (11)$$

Further in the present embodiment, a maximum distance H from an arbitrary point on the first light diffusing surface 68 to the light emitting surface 14 is set to H=22.3 mm.

Figure 10:
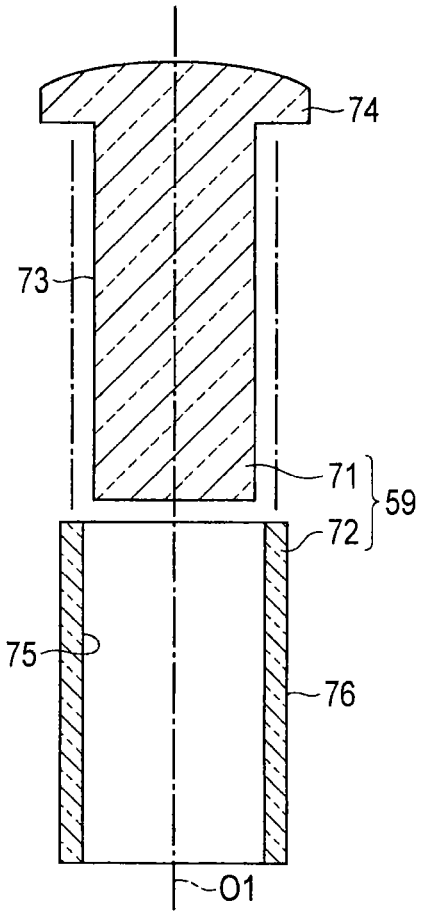
FIG. 10 is a sectional view of a light diffuser used in the second embodiment.

As shown in FIGS. 8, 9, and 10, the light diffuser 59 of the light guide 54 is contained in the hollow part 62 of the light guide column 58. The light diffuser 59 is made of, for example, transparent acryl.

The light diffuser 59 comprises a post part 71 and a cylinder part 72. The post part 71 is a solid cylindrical component having a smaller diameter than the hollow part 62, and has a second light diffusing surface parallel to the optical axis O1. Further, a flange part 74 is coaxially formed at an end of the post part 71. The flange part 74 protrudes in radial directions of the post part 71 from the outer circumferential surface 73.

The cylinder part 72 comprises an inner circumferential surface 75 and an outer circumferential surface 76 both parallel to the optical axis O1. The cylinder part 72 is fixed to a lower surface of the flange part 74 by means of adhesion so as to coaxially surround the post part 71, and is thereby integrated with the post part 71.

The flange part 74 is fixed to a tip end of the light guide column 58 by means of adhesion so as to close an open end of the hollow part 62. By this fixture, the post part 71 and the cylinder part 72 of the light diffuser 59 are coaxially held inside the hollow part 62.

Further, a first air layer 78 is provided between the first light diffusing surface 68 of the hollow part 62 and the outer circumferential surface 76 of the cylinder part 72, and a second air layer 79 is provided between the inner circumferential surface 75 of the cylinder part 72 and the outer circumferential surface 73 of the post part 71.

According to the present embodiment, the outer circumferential surface 73 of the post part 71, and the inner circumferential surface 75 and outer circumferential surface 76 of the cylinder part 72 are made of rough surfaces having light diffusibility. The rough surfaces are formed by so-called sandblasting of spraying, for example, a polishing material having a grain diameter of 100 μm to the post part 71.

Therefore, the outer circumferential surface 73 of the post part 71, and the inner circumferential surface 75 and outer circumferential surface 76 of the cylinder part 72 can function as a second light diffusing surface, a third light diffusing surface, and a fourth light diffusing surfaces, respectively.

In the light guide column 58 having such a light diffuser 59 as described, an end which comprises the incident plane 60 is held in the support part 56 of a lamp body 2. Therefore, the tapered region 64 of the light guide column 58 including the light diffuser 59 is positioned in the central part of the globe 53.

Strongly directive light which is emitted from the light emitting surface 4 of the light emitting module 4 is made to enter the light guide column 58 through the incident plane 60. The light which is made to enter the light guide column 58 is totally reflected on the outer circumferential surface 61, and travels toward the hollow part 62. Light which travels through the vicinity of the hollow part 62 toward the tapered region 64 enters the tapered region 64 at an incident angle to the tapered region 64 of not less than critical angle $\theta_C$, in accordance with the inclination of the tapered region 64.

Thus the light which is made to enter the tapered region 64 is totally reflected toward the first light diffusing surface 68 of the hollow part 62.

Figure 11:
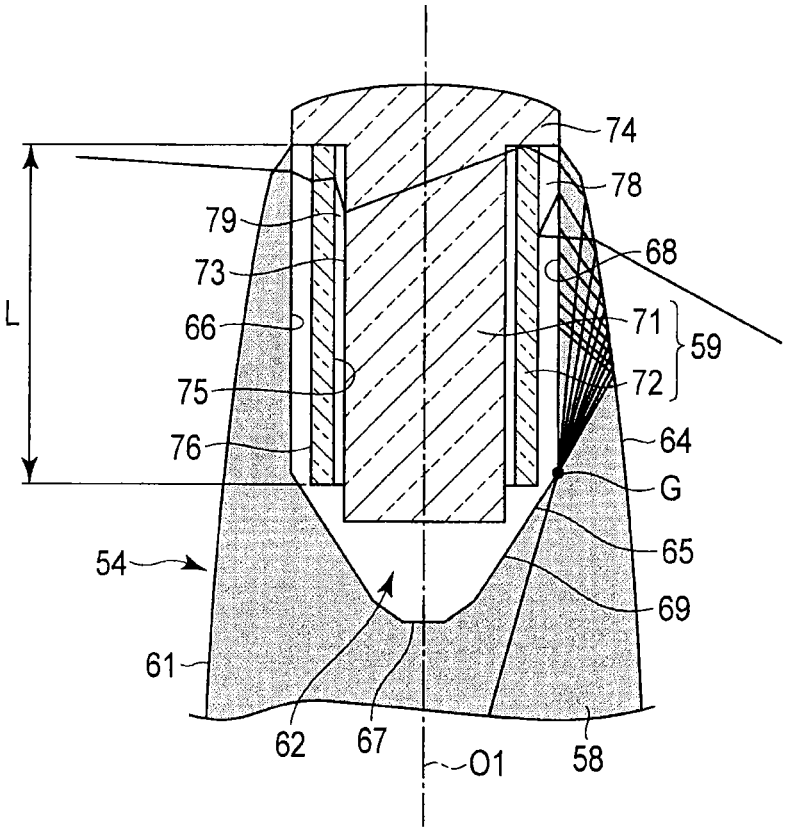
FIG. 11 is a diagram showing paths of light rays which have been reflected on an outer circumferential surface of the light guide member in the second embodiment.

FIG. 11 is a diagram showing light rays obtained by simulating light rays which travel toward the tapered region 64 through a point G positioned near a boundary between the first light diffusing surface 68 and the diffusion region 69. FIG. 11 shows a partial cross section of the tapered region 64 of the light guide column 58 including the optical axis O1.

According to FIG. 11, the light which travels through the point G toward the tapered region 64 is totally reflected on the tapered region 64 toward the first light diffusing surface 68 of the hollow part 62, and is diffused on the first light diffusing surface 68.

At this time, as the length L of the first light diffusing surface 68 satisfies the foregoing expression (2), the light which is totally reflected on the tapered region 64 after passing the point G is inevitably led to the first light diffusing surface 68.

Further according to the present embodiment, the first air layer 78 is provided between the first light diffusing surface 68 of the hollow part 62 and the outer circumferential surface 76 of the cylinder part 72, and the second air layer 79 is provided between the inner circumferential surface 75 of the cylinder part 72 and the outer circumferential surface 73 of the post part 71. Therefore, the light diffused on the first light diffusing surface 68 penetrates the cylinder part 71 through the first air layer 78, and penetrates the post part 71 through the second air layer 79.

That is, when the light which travels in a direction intersecting the optical axis O1 from the first light diffusing surface 68 passes the outer circumferential surface 76 of the inner circumferential surface 75 of the cylinder part 72 and the outer circumferential surface 73 of the post part 71, the light is diffused a number of times corresponding to the number of surfaces described above. As a result, light can be diffused over a wider range and the light distribution angle of the light finally emitted from the tapered region 64 of the light guide column 58 can be widened.

Figure 12:
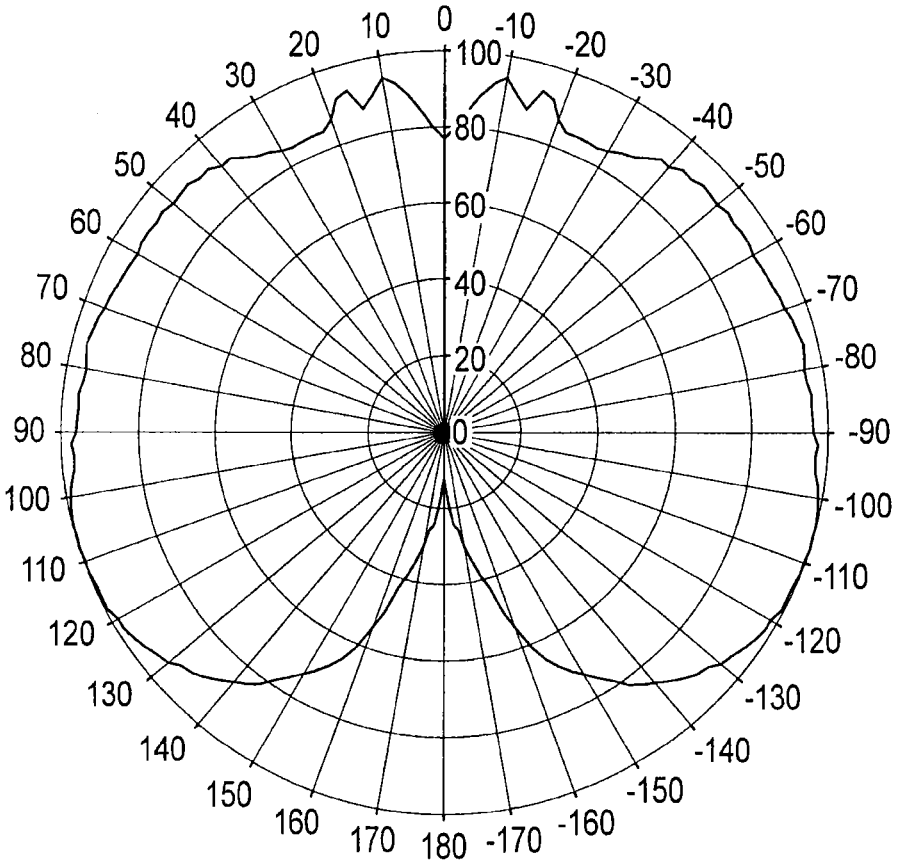
FIG. 12 is a chart showing the distribution of light which has penetrated the light guide member in the second embodiment.

FIG. 12 shows a result of performing a ray-tracing simulation of light distribution of light emitted from the light guide column 58 which is provided with the light diffuser 59 in the LED lamp 51 according to the present embodiment. In FIG. 12, luminous intensity is expressed as a radar chart in relation to a light ray direction in which the direction of light extracted along the optical axis O1 of the light emitting module 4 is set to 0 degrees.

According to FIG. 12, the intensity of light emitted in the direction perpendicular to the optical axis O1 is great, and the maximum luminous intensity falls within a range of 90 to 120 degrees relative to the optical axis O1. On a light distribution curve shown in FIG. 12, a light distribution angle defined by two directions, at which half of the luminous intensity of the maximum luminous intensity is obtained, is approximately 320 degrees, which is substantially equivalent to an incandescent light bulb.

Further, it has been confirmed that the luminaire efficiency of the LED lamp 51 is 90% where an absorption factor of light which reenters the light-emitting module 4 is 60%.

According to the second embodiment, the tapered region 64 inclined in a direction towards the optical axis O1 is provided at the tip end of the light guide column 58, and the first light diffusing surface 68 parallel to the optical axis O1 is included in the tapered region 64.

In this manner, a normal vector which extends toward the optical axis O1 from an arbitrary point on the tapered region 64 is inclined so as to be directed to the bottom of the hollow part 62 in relation to a line segment perpendicular to the optical axis O1. Therefore, in comparison with the outer circumferential surface of the light guide column 58 which is parallel to the axial direction of the optical axis O1, the length L of the first light diffusing surface 68 can be shortened.

As a result, the light guide column 58 can have a compact shape, and the shape of light emitted from the tip end of the light guide column 58 is much closer to that of a point light source. Therefore, in cooperation with the transparent appearance of the tip end of the light guide column 58 which emits light through the transparent globe 3, light can be spread to create a sense of glittering highly similar to that of a clear electric light bulb.

Third Embodiment

Figure 13:
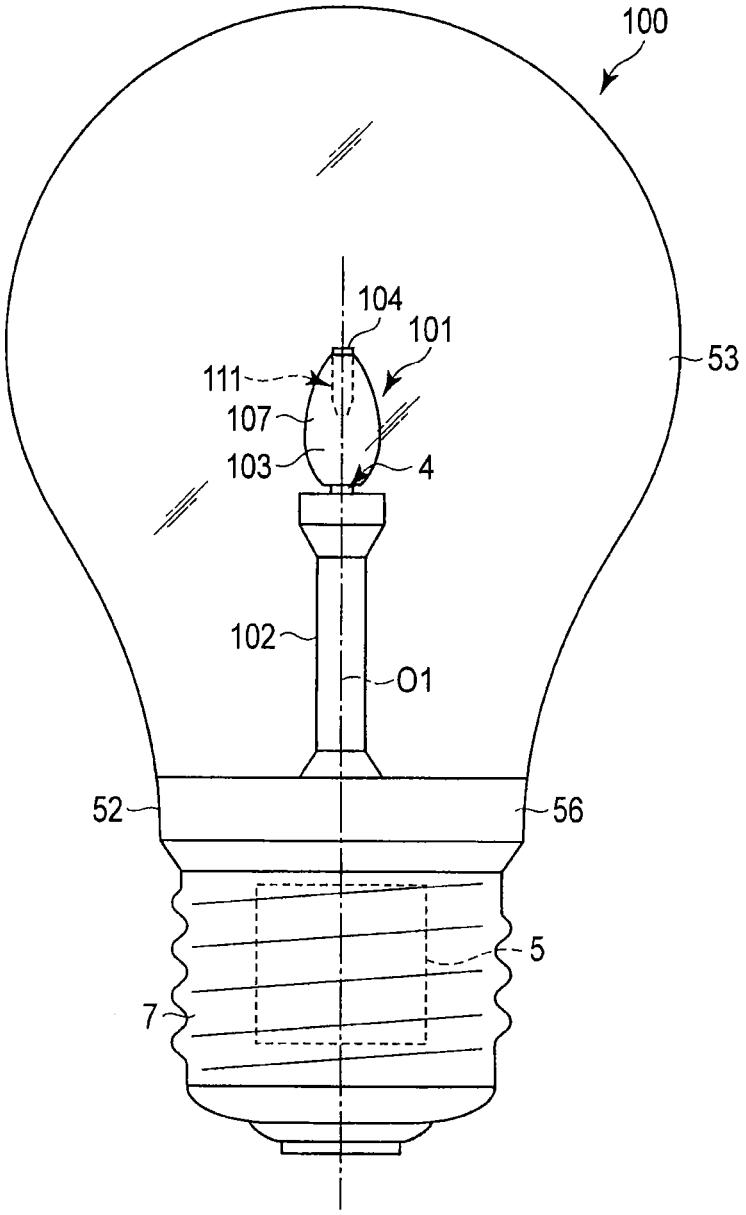
FIG. 13 is a side view of an LED lamp according to the third embodiment.
Figure 14:
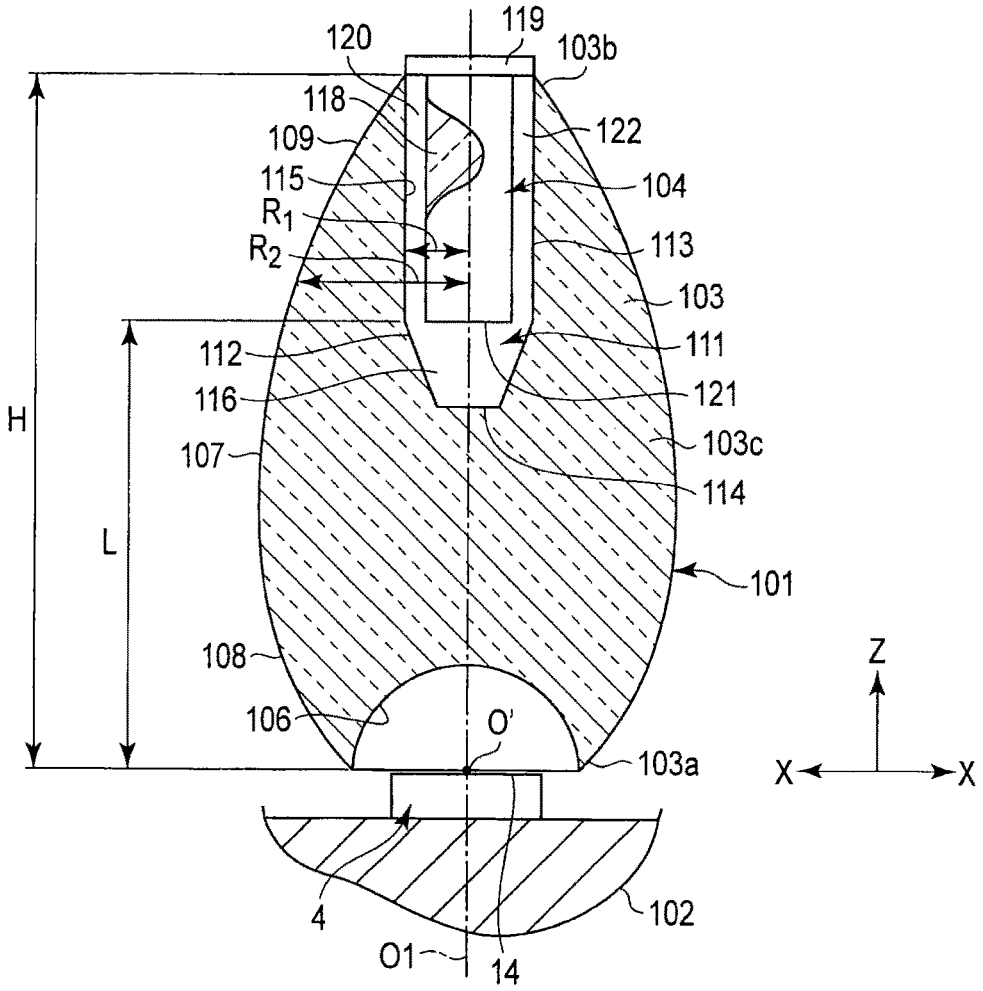
FIG. 14 is a sectional view of a light guide member used in the third embodiment.
Figure 15:
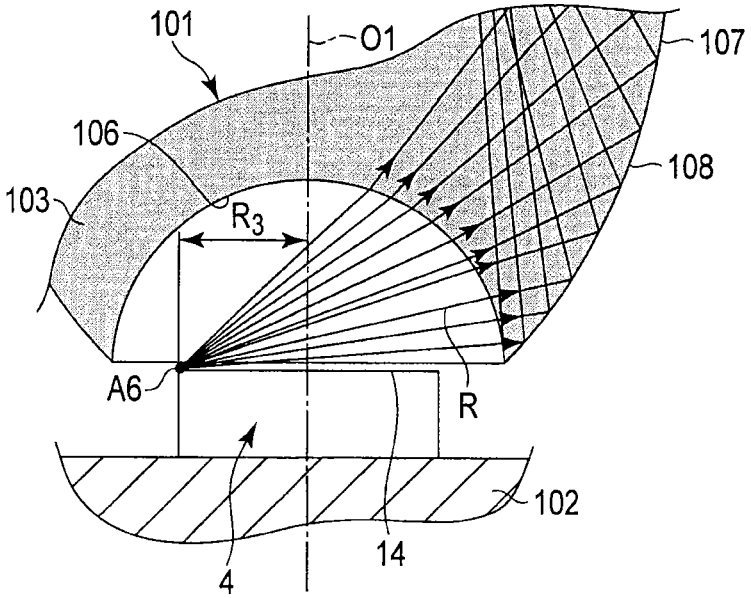
FIG. 15 is a diagram showing paths of light rays which have entered the light guide member from the incident plane in the third embodiment.

FIGS. 13, 14, and 15 disclose the third embodiment.

An LED lamp 100 according to the third embodiment is different from the second embodiment principally in a light guide 101 and a configuration of supporting the light guide 101 by a lamp body 52. The remaining configuration is basically the same as that of the second embodiment. Therefore, in the third embodiment, the same components as those in the second embodiment will be denoted with the same reference signs, respectively, and descriptions thereof will be omitted.

As shown in FIG. 13, a stay 102 is supported at a central part of a lamp body 52. The stay 102 is made of a metal material having more excellent thermal conductivity than iron, such as aluminum, and functions also as a heat radiator. The stay 102 is covered with a globe 53, and is protruded toward the central part of the globe 53 from the lamp body 52.

A light emitting module 4 which is a light source of the LED 100 is fixed to a central part of the stay 102 by, for example, screwing or adhesion. The stay 102 is arranged to be coaxial with an optical axis O1 of the light emitting module 4. A lighting circuit 5 which supplies a constant current to the light emitting module 4 is contained in a base 7.

In the present embodiment, a light emitting surface 14 of the light emitting module 4 is, for example, a square whose edges each have a length of 3.2 mm. As shown in FIG. 15, a distance $R_3$ to the optical axis O1 along the direction perpendicular to the optical axis O1 from an end point A6 on a peripheral edge of the light emitting surface 14 can be expressed as follows where C is the area of the light emitting surface 14.

$$R_3 = \sqrt{\frac{C}{\pi}} \tag{12}$$

Accordingly, the distance R3=1.8 is obtained.

As shown in FIGS. 13 and 14, the light guide 101 is contained inside the globe 53 so as to face the light emitting surface 14 of the light emitting module 4. The light guide 101 comprises a light guide column 103 and a light diffuser 104.

The light guide column 103 is an example of a light guide member and is provided coaxially with the optical axis O1. The light guide column 103 has a shape which is rotationally symmetrical about the optical axis O1. Further, the light guide column 103 is made of, for example, transparent acryl, though is not limited to acryl. Any material can be appropriately selected and used insofar as the material allows visible light to penetrate.

The light guide column 103 comprises a first end 103*a* and a second end 103*b* which are apart from each other in an axial direction of the optical axis O1. The first end 103*a* of the light guide column 103 has a shape one size greater than the light emitting surface 14, and an incident plane 106 is formed in the first end 103*a*. The incident plane 106 has a semi-spherical shape which is recessed toward the inside of the light guide column 103, centering on the optical axis O1. The incident plane 106 has a radius of 2.0 mm.

Further, the light guide column 103 comprises an outer circumferential surface 107 which connects the first end 103*a* and the second end 103*b*. The outer circumferential surface 107 coaxially surrounds the optical axis O1, and is arcuately curved so as to extend in a direction perpendicular to the optical axis O1 in an intermediate part 103*c* between the first end 103*a* and the second end 103*b* of the light guide column 103.

In other words, the outer circumferential surface 107 of the light guide column 103 comprises a first tapered region 108 positioned between the first end 103*a* and the intermediate part 103*c* of the light guide column 103, and a second tapered region 109 positioned between the second end 103*b* and the intermediate part 103*c* of the light guide column 103.

The first tapered region 108 is curved so as to approach the optical axis O1, from the intermediate part 103*c* along a direction toward the first end 103*a*. The second tapered region 109 is curved so as to approach the optical axis O1, from the intermediate part 103*c* along a direction toward the second end 103*b*.

Therefore, the intermediate part 103*c* of the light guide column 103 defines the maximum diameter of the light guide column 103. In the present embodiment, the light guide column 103 has the maximum diameter of 9.0 mm. The incident plane 106 of the light guide column 103 is inside the first tapered region 108.

The outer circumferential surface 107 including the first tapered region 108 and the second tapered region 104 can function as a total reflection surface which totally reflects light of the light emitting module 11 which is made to enter the light guide column 103 from the incident plane 106. The outer circumferential surface 107 as a total reflection surface is finished into a smooth glossy surface.

As shown in FIG. 14, a hollow part 111 is provided in the light guide column 103 in the side of the second end 103*b*. The hollow part 111 has an approximately cylindrical shape coaxial with the optical axis O1 and is open in the side opposite to the light guide column 106.

An inner surface 112 which defines the hollow part 111 comprises a circumferential surface 113 surrounding the optical axis O1 and a bottom surface 114 perpendicular to the optical axis O1. The circumferential surface 113 includes a first light diffusing surface 115 parallel to the optical axis O1. The first light diffusing surface 115 is inside the second tapered region 109 of the light guide column 103. The bottom surface 114 faces the incident plane 106 at the bottom of the hollow part 111.

Further, the inner surface 112 of the hollow part 111 comprises a diffusion region 116 which connects the first light diffusing surface 115 and the bottom surfaces 114. The diffusion region 116 is defined by a tapered surface inclined so as to gradually approach the optical axis O1 from the first light diffusing surface 115 toward the bottom surface 114.

The inner surface 112 of the hollow part 111 including the first light diffusing surface 115 is made of a rough surface having light diffusibility. The rough surface is formed by so-called sandblasting of spraying, for example, a polishing material having a diameter of 100 μm to the inner surface 112.

FIG. 14 shows a cross-sectional shape of the hollow part 111 where the light guide column 103 is cut along a plane including the optical axis O1. According to the present embodiment, a distance $R_1$ to the optical axis O1 along the direction perpendicular to the optical axis O1 from the first light diffusing surface 115 is supposed to be 1.4 mm, a maximum distance $R_2$ to the optical axis O1 along the direction perpendicular to the optical axis O1 from the second tapered region 109 which includes the first light diffusing surface 115 is supposed to be 4.0 mm, and a length L of the first light diffusing surface 115 along the axial direction of the optical axis O1 is supposed to be 7.0 mm.

Then, the first light diffusing surface 115 of the hollow part 111 satisfies a relationship below where a critical angle is expressed as $\theta_C$.

$$L=7.0\geq 2(R_2-R_1)\tan\theta_C=4.7 \tag{13}$$

Further, in the present embodiment, a maximum distance H from an arbitrary point on the first light diffusing surface 115 to the light emitting surface 14 is set to H=15.0 mm.

A specific shape of the outer circumferential surface 107 of the light guide column 103 will be described with reference to FIG. 14. In FIG. 14, shown is a line segment which extends from an arbitrary point on the incident plane 106 of the light guide column 103 as a start point and is perpendicular to the optical axis O1. Among points at which the line segment intersects the optical axis O1, a point closest to the light emitting surface 14 is expressed as O'.

The point O' is taken as an origin point. A direction of light extracted along the optical axis O1 from the point O' is expressed as a direction z. A direction which is perpendicular to the optical axis O1 and extends along the light emitting surface 14 is expressed as a direction x. Further, a distance to the first end 103*a* from a point on the x-axis, which is closest to an end point A6 on a peripheral edge of the light emitting surface 14, is expressed as l. The shape of the outer circumferential surface 107 as a total reflection surface can be expressed as follows.

$$x=l\exp(\tan\theta_a\Theta)\cos\Theta-R_3 \tag{14}$$

$$z=l\exp(\tan\theta_a\Theta)\sin\Theta \tag{15}$$

In the foregoing expressions (14) and (15), the parameter Θ represents a finite range included in a range expressed below.

$$0\leq\Theta\leq\frac{\pi}{2} \tag{16}$$

In the foregoing expressions (14) and (15), the real constant $\theta_a$ represents a finite range included in a range expressed below.

$$\theta_C\leq\theta_a<\frac{\pi}{2} \tag{17}$$

In the foregoing expressions (14) and (15), the real constant l is as follows.

$$l \geq 2R_3 \quad (18)$$

Thus, by defining the shape of the outer circumferential surface 107 of the light guide column 103, most of the light which is made to enter the light guide column 103 from the incident plane 106 can be totally reflected on the outer circumferential surface 107.

At this time, the distance to the optical axis O1 along the direction perpendicular to the optical axis O1 from the outer circumferential surface 107 at the point on the outer circumferential surface 107 at which $\Theta=\theta_a$ is given is maximized. An inward normal which extends toward the optical axis O1 from the point at which $\Theta=\theta_a$ is given is perpendicular to the optical axis O1.

In the present embodiment, the shape of the outer circumferential surface 107 of the light guide column 103 is greatly different from a straight circular column. Therefore, the expression (4) of the first embodiment described above is not applicable.

As shown in FIG. 14, the light diffuser 104 of the light guide 101 is almost completely contained in the hollow part 111 of the light guide column 103. The light diffuser 104 is made of, for example, transparent acryl, though is not limited to acryl. Any material can be appropriately selected and used insofar as the material allows visible light to penetrate.

The light diffuser 104 comprises a post part 118 and a flange part 119. The post part 118 is a solid cylindrical component having a smaller diameter than the hollow part 111, and has a second light diffusing surface 120 parallel to the optical axis O1, and a flat end surface 121 perpendicular to the optical axis O1.

The flange part 119 is formed coaxially on the end opposite to the end surface 121 of the post part 118, and protrudes in radial directions of the post part 118.

The flange part 119 is fixed to a second tip end 103 of the light guide column 103 by means of adhesion so as to close an open end of the hollow part 111. By this fixture, the post part 118 of the light diffuser 104 is held coaxially inside the hollow part 111, and an air layer 122 is provided between the first light diffusing surface 115 of the hollow part 111 and the second light diffusing surface 120 of the light diffuser 104.

According to the present embodiment, surfaces of the second light diffusing surface 120 of the light diffuser 104, the end surface 121, and the flange part 119 are made of rough surfaces having light diffusibility. The rough surfaces are formed by so-called sandblasting of spraying, for example, a polishing material having a grain diameter of 100 μm to the light diffuser 17.

Further, the light guide column 103 comprising the light diffuser 104 is positioned in the central part of the globe 53.

Strongly directive light which is emitted from the light emitting surface 14 of the light emitting module 4 is made to enter the light guide column 103 through the incident plane 106. The incident plane 106, which is semi-spherically recessed, guides light to the first tapered region 108 of the outer circumferential surface 107, without substantially changing refraction directions of the light, when light emitted from the peripheral part of the light emitting surface 14 is made to enter.

FIG. 15 is a diagram showing light rays obtained by simulating light rays R which travel from the peripheral part of the light emitting surface 14 toward the incident plane 106. FIG. 15 shows a partial cross section of the first tapered region 108 of the light guide column 103 including the optical axis O1.

According to FIG. 15, the light which travels toward the incident plane 106 from the peripheral part of the light emitting surface 14 penetrates inside of the light guide column 103 and further travels toward the first tapered region 108, without substantially changing incident directions relative to the incident plane 106.

That is, if light which is made to enter the incident plane 106 is refracted greatly, the component of light which returns from the incident plane 106 to the light emitting surface 14 increases, and the light is absorbed by the light emitting module 4. In contrast, in the present embodiment, light which is made to enter the incident plane 106 is led to the first tapered region 108, without substantially changing incident directions, and is totally reflected thereon.

Therefore, loss of light which is made to enter the light guide column 103 can be suppressed as much as possible, and the luminaire efficiency of the LED lamp 100 improves.

The light which is totally reflected on the first tapered region 108 penetrates inside of the light guide column 103 toward the hollow part 111, and reaches and is diffused on the inner surface 112 of the hollow part 111 and the light diffuser 104. The diffused light is diffused in all directions principally from the second tapered region 109 of the light guide column 103.

According to the third embodiment, the second tapered region 109 inclined in a direction towards the optical axis O1 is provided at the tip end of the light guide column 103, and the first light diffusing surface 115 parallel to the optical axis O1 is included in the second tapered region 109.

In this manner, a normal vector which extends toward the optical axis O1 from an arbitrary point on the second tapered region 109 is inclined so as to be directed to the bottom of the hollow part 111 in relation to a line segment perpendicular to the optical axis O1. Therefore, in comparison with the outer circumferential surface of the light guide column 103 which is parallel to the axial direction of the optical axis O1, the length L of the first light diffusing surface 115 can be shortened.

As a result, the light guide column 103 can have a compact shape, and the shape of light emitted from the tip end of the light guide column 103 is much closer to that of a point light source. Therefore, in cooperation with the transparent appearance of the tip end of the light guide column 103 which emits light through the transparent globe 53, light can be spread to create a sense of glittering highly similar to a clear electric light bulb.

In the first through third embodiments, the light diffuser contained in the hollow part of the light guide column is not a mandatory component but may be omitted depending on targeted light distribution characteristics. If the light diffuser is omitted, for example, a coating material including particles which highly scatter light is desirably coated on the inner surface of the hollow part, to improve the light-diffusing performance of the inner surface.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

Additionally, configurations of a light guide according to the present invention will be described hereinafter.

[1] A light guide which is provided coaxially with an axis extending through a centroid of the light emitting surface along a direction perpendicular to the light emitting surface, and allows light emitted from the light emitting surface to penetrate, comprising:

an incident plane facing the light emitting surface;

a total reflection surface which is extended from an outer peripheral edge of the incident plane in a direction extending away from the light emitting surface so as to surround the axis, and is configured to totally reflect the light which is made to enter the light guide from the incident plane;

a hollow part which is provided at a position distant from the incident plane along an axial direction of the axis, and comprises a first light diffusing surface parallel to the axis, to which the light totally reflected on the outer circumferential surface is led; and a light diffuser provided in the above-mentioned hollow part.

[2] The light guide described in the foregoing article [1], wherein the light diffuser comprises a second light diffusing surface facing the first light diffusing surface, and an air layer is provided between the first light diffusing surface and the second light diffusing surface.

[3] The light guide described in the foregoing article [1], wherein the light diffuser comprises a solid post part and a cylinder part which surrounds the post part, a first air layer is provided between the outer circumferential surface of the cylinder part and the first light diffusing surface, and a second air layer is provided between inner and outer circumferential surfaces of the cylinder part.

[4] The light guide described in one of the articles [1] through [3], wherein the hollow part comprises a diffusion region inclined so as to approach the axis, from the first light diffusing surface toward the light emitting surface.

[5] The light guide described in one of the foregoing articles [1] through [4], wherein the total reflection surface comprises a finite region which surrounds the hollow part and is inclined so as to approach the axis as a distance from the incident plane increases throughout the finite region.

[6] The light guide described in one of the foregoing articles [1] through [5], wherein the total reflection surface has a shape which is curved so as to widen in a direction perpendicular to the axis, and the incident plane is curved so as to be recessed toward the hollow part.

[7] The light guide described in one of the foregoing articles [1] through [5], wherein, where a distance from the first light diffusing surface to the axis along the direction perpendicular to the axis is $R_1$, a maximum distance from the total reflection surface including the first light diffusing surface to the axis along the direction perpendicular to the axis is $R_2$, a length of the first light diffusing surface along the axial direction of the axis along the first light diffusing surface is L, and a critical angle of total reflection of the light guide is $\theta_C$, the first light diffusing surface satisfies an expression of $$L \geq 2(R_2 - R_1)\tan\theta_C, \tag{19}$$

and, where a refractive index of the light guide member is n, the critical angle $\theta_C$ of the light guide satisfies an expression of $$\theta_C = \sin^{-1}\left(\frac{1}{n}\right). \tag{20}$$

[8] The light guide described in the foregoing article [7], wherein, where the light guide is cut along a plane including the axis, the total reflection surface includes a finite region having a shape in which an angle defined between a normal vector extending from an arbitrary point on the total reflection surface toward the axis and a vector extending toward an outer edge of the light emitting surface is not smaller than the critical angle $\theta_C$.

[9] The light guide described in one of the foregoing articles [1] through [8], wherein the first light diffusing surface has a tip end positioned in a side opposite to the incident plane along the axial direction of the axis, and, where the light guide is cut along the plane including the axis and a distance from a peripheral edge of the light emitting surface to the axis along the direction perpendicular to the axis is $R_3$, a distance H from the tip end of the first light diffusing surface to the light emitting surface along the axial direction of the axis satisfies an expression of $$H \geq (2R_2 + R_3 - R_1)\tan\theta_C \tag{21}$$

[10] The light guide described in the foregoing article [9], wherein, where a light emission area of the light emitting surface is C, the distance R3 satisfies an expression of $$R_3 = \sqrt{\frac{C}{\pi}}. \tag{22}$$

[11] The light guide described in the foregoing article [6], wherein, where the light guide is cut along a plane including the axis, an intersection point of a line segment intersecting the axis is taken as an origin point, the line segment being perpendicular to the axis and extending from the outer peripheral edge of the incident plane, a direction in which light is emitted from the origin point along the axis is a direction z, a direction perpendicular to the direction z and extending from the origin point along the light emitting surface is a direction x, a distance to an arbitrary point on the incident plane from a point on an x-axis, which is closest to a peripheral edge of the light emitting surface, is 1, and a distance from the peripheral edge of the light emitting surface to the axis along the direction perpendicular to the axis is $R_3$, the total reflection surface of the light guide member is defined by an expression of $$x = l\exp(\tan\theta_a\Theta)\cos\Theta - R_3$$

$$z = l\exp(\tan\theta_a\Theta)\sin\Theta \tag{23},$$

a parameter $\Theta$ is a finite region included in a range of $$0 \leq \Theta \leq \frac{\pi}{2}, \tag{24}$$

a real constant $\theta_a$ satisfies an expression of, $$\theta_C < \theta_a < \frac{\pi}{2}, \tag{25}$$

and a real constant l is $$l \geq 2R_3 \tag{26}$$

[12] The light guide described in one of the foregoing articles [1] through [7], wherein where a length of the first light diffusing surface along the axial direction of the axis is L, the length L satisfies $$1 \leq \frac{L}{2(R_2 - R_1)\tan\theta_C} \leq 16. \tag{27}$$

The invention claimed is:

1. A lighting apparatus, comprising:

a light source which comprises a light emitting surface configured to emit light planarly by using a semiconductor light emitting device; and a light guide member which extends through a centroid of the light emitting surface and is provided to be coaxial with an axis along an axial direction perpendicular to the light emitting surface, and allows the light of the light source to penetrate, wherein the light guide member comprises:

an incident plane facing the light emitting surface, an outer circumferential surface which is extended from an outer peripheral edge of the incident plane in the axial direction so as to surround the axis, and is configured to totally reflect the light of the light source which is made to enter the light guide member from the incident plane, and a hollow part which is provided at a position distant from the incident plane along the axial direction and is provided inside the outer circumferential surface, wherein a circumferential surface of the hollow part extending in the axial direction is a first light diffusing surface to which the light totally reflected on the outer circumferential surface is led.

2. The lighting apparatus according to claim 1, wherein the light guide member has a shape which extends in the axial direction and is rotationally symmetrical about the axis.

3. The lighting apparatus according to claim 1, wherein the light guide member further comprises a light diffuser provided in the hollow part.

4. The lighting apparatus according to claim 3, wherein the light diffuser has a second light diffusing surface which faces the first light diffusing surface of the light guide member.

5. The lighting apparatus according to claim 4, wherein an air layer is provided between the first light diffusing surface and the second light diffusing surface.

6. The lighting apparatus according to claim 3, wherein the light diffuser comprises a solid post part and a cylinder part which surrounds the solid post part, a first air layer is provided between the outer circumferential surface of the cylinder part and the first light diffusing surface, and a second air layer is provided between the inner circumferential surfaces of the cylinder part and the outer circumferential surfaces of the solid post part.

7. The lighting apparatus according to claim 1, wherein the first light diffusing surface is included inside the light guide member.

8. The lighting apparatus according to claim 1, wherein the hollow part includes a diffusion region which is inclined so as to approach the axis, from the first light diffusing surface toward the light emitting surface.

9. The lighting apparatus according to claim 1, wherein the outer circumferential surface of the light guide member comprises a finite region which surrounds the hollow part and is inclined so as to approach the axis as a distance from the light source increases throughout the finite region.

10. The lighting apparatus according to claim 1, wherein the outer circumferential surface of the light guide member has a shape which is curved so as to widen in a direction perpendicular to the axis, and the incident plane is curved so as to be recessed toward the hollow part.

11. The lighting apparatus according to claim 1, further comprising a globe which covers the light guide member.

12. The lighting apparatus according to claim 11, wherein the hollow part including the first light diffusing surface is positioned in a central part of the globe.

13. The lighting apparatus according to claim 10, wherein where a distance from the first light diffusing surface to the axis along the direction perpendicular to the axis is $R_1$, a maximum distance from the outer circumferential surface including the first light diffusing surface to the axis along the direction perpendicular to the axis is $R_2$, a length of the first light diffusing surface along the axial direction of the axis is L, and a critical angle of total reflection of the light guide member is $\theta_C$, the first light diffusing surface satisfies an expression of $$L \geq 2(R_2 - R_1)\tan\theta_C, \tag{2}$$

and where a refractive index of the light guide member is n, a critical angle $\theta_C$ of the light guide member satisfies an expression of $$\theta_C = \sin^{-1}\left(\frac{1}{n}\right). \tag{1}$$

14. The lighting apparatus according to claim 13, wherein where the light guide member is cut along a plane including the axis, the outer circumferential surface of the light guide member includes a shape in which an angle defined between a normal vector extending from an arbitrary point on the outer circumferential surface toward the axis and a vector extending toward an outer edge of the light emitting surface is not smaller than a critical angle $\theta_C$.

15. The lighting apparatus according to claim 14, wherein the point on the outer circumferential surface includes a point at which the normal vector intersects, at right angles, the axis and the distance to the axis is maximized.

16. The lighting apparatus according to claim 1, wherein the first light diffusing surface of the light guide member has a tip end positioned in a side opposite to the incident plane along the axial direction of the axis, and, where the light guide member is cut along a plane including the axis and a distance from a point on a peripheral edge of the light emitting surface to the axis along a direction perpendicular to the axis is $R_3$, a distance H from the tip end of the first light diffusing surface to the light emitting surface along the axial direction of the axis satisfies an expression of $$H \geq (2R_2 + R_3 - R_1)\tan\theta_C \quad (4).$$

17. The lighting apparatus according to claim 16, wherein, where a light emission area of the light emitting surface is C, the distance $R_3$ satisfies an expression of $$R_3 = \sqrt{\frac{C}{\pi}}. \quad (5)$$

18. The lighting apparatus according to claim 10, wherein, where the light guide member is cut along a plane including the axis, an intersection point of a line segment intersecting the axis is taken as an origin point, the line segment being perpendicular to the axis and extending from the outer peripheral edge of the incident plane, a direction in which light is emitted from the origin point along the axis is a direction z, a direction perpendicular to the direction z and extending from the origin point along the light emitting surface is a direction x, a distance to an arbitrary point on the incident plane from a point on an x-axis, which is closest to a peripheral edge of the light emitting surface, is 1, and a distance from the peripheral edge of the light emitting surface to the axis along the direction perpendicular to the axis is $R_3$, the outer circumferential surface of the light guide member is defined by an expression of $$x = l\exp(\tan\theta_a\Theta)\cos\Theta - R_3$$

$$z = l\exp(\tan\theta_a\Theta)\sin\Theta \quad (23),$$

a parameter $\Theta$ is a finite region included in a range of $$0 \leq \Theta \leq \frac{\pi}{2}, \quad (24)$$

a real constant $\theta_a$ satisfies an expression of, $$\theta_C \leq \theta_a < \frac{\pi}{2}, \quad (25)$$

and a real constant 1 is $$l \geq 2R_3 \quad (26).$$

19. A lighting apparatus, comprising:

a light source which comprises a semiconductor light emitting element and a light emitting surface configured to emit light; and a light guide member provided coaxially with an axis extending along an axial direction perpendicular to the light emitting surface, the light guide member configured to allow the light of the light source to penetrate, wherein the light guide member comprises:

an incident plane facing the light emitting surface, an outer circumferential surface which is extended from an outer peripheral edge of the incident plane in the axial direction so as to surround the axis, and is configured to totally reflect the light which is made to enter the light guide member from the incident plane, and a hollow part which is provided at a position distant from the incident plane along the axial direction and is provided inside the outer circumferential surface, and comprises a first light diffusion surface extending in the axial direction to which the light totally reflected on the outer circumferential surface is led;

where a length of the first light diffusing surface along the axial direction is L, the light guide member satisfies an expression of $$1 \leq \frac{L}{2(R_2 - R_1)\tan\theta_C} \leq 16. \quad (27)$$

a distance from the first light diffusing surface to the axis along the direction perpendicular to the axis is $R_1$, a maximum distance from the outer circumferential surface including the first light diffusing surface to the axis along the direction perpendicular to the axis is $R_2$, a critical angle of total reflection of the light guide member is $\theta_C$.

20. A light guide which is provided to be coaxial with an axis extending through a centroid of the light emitting surface along an axial direction and being perpendicular to a light emitting surface, and allows light emitted from the light emitting surface to penetrate, comprising:

an incident plane facing the light emitting surface;

a total reflection surface which is extended from an outer peripheral edge of the incident plane in the axial direction extending away from the light emitting surface so as to surround the axis, and is configured to totally reflect the light which is made to enter the light guide from the incident plane, and a hollow part which is provided at a position distant from the incident plane along the axial direction and is provided inside the total reflection surface, wherein a circumferential surface of the hollow part extending in the axial direction is a first light diffusing surface to which the light totally reflected on the total reflection surface is led.

* * * * *